US005309681A

United States Patent [19]

Cheney et al.

[11] Patent Number: 5,309,681

[45] Date of Patent: May 10, 1994

[54] CONFORMABLE SANDING ASSEMBLY

[76] Inventors: Christopher Cheney, 51 Lawrence La.; Bryan Sharlow, 2 Pamela Dr., both of Portsmouth, N.H. 03801

[21] Appl. No.: 80,002

[22] Filed: Jun. 21, 1993

Related U.S. Application Data

[63] Continuation-in-part of Ser. No. 733,340, Jul. 22, 1991, Pat. No. 5,220,752.

[51] Int. Cl.[5] ..... B24B 23/00; B24D 9/00; B24D 11/00

[52] U.S. Cl. ..... 51/170 R; 51/358; 51/406; 51/407

[58] Field of Search ..... 51/170 R, 170 MT, 170 TL, 51/170 T, 401, 402, 406, 407, 394, 358, 391, 392, 181 R

[56] References Cited

U.S. PATENT DOCUMENTS

| | | | |
|---|---|---|---|
| 3,089,294 | 5/1963 | Cowley | 51/392 |
| 3,129,540 | 4/1964 | Valles | 51/391 |
| 3,540,160 | 11/1970 | DeRose et al. | 51/391 |
| 4,263,755 | 4/1981 | Globus | 51/406 |
| 4,558,542 | 12/1985 | Marton | 51/407 |
| 4,617,767 | 10/1986 | Ali | 51/406 |
| 5,007,128 | 4/1991 | Englund et al. | 51/401 |
| 5,022,189 | 6/1991 | Saul | 51/170 MT |
| 5,025,596 | 6/1991 | Heyer et al. | 51/394 |
| 5,054,245 | 10/1991 | Coty | 51/170 R |
| 5,123,139 | 6/1992 | Leppert et al. | 51/358 |
| 5,170,595 | 12/1992 | Wiand | 51/407 |
| 5,201,785 | 4/1993 | Nagano | 51/406 |

FOREIGN PATENT DOCUMENTS

| | | | |
|---|---|---|---|
| 0351273 | 1/1990 | European Pat. Off. | 51/406 |
| 2620367 | 3/1989 | France | 51/393 |

*Primary Examiner*—Roscoe V. Parker
*Attorney, Agent, or Firm*—Frederick R. Cantor

[57] ABSTRACT

A conformable sanding assembly incorporating a flexible attachment for ready attachment to a hand or power sander. The sanding assembly is particularly useful for sanding contoured, and other non-planar surfaces and angles. The sanding assembly comprises a compressible sanding block said sanding block further comprising peripheral surfaces of an abrasive material and, said sanding block further comprising a flexible attachment. The flexible attachment is designed for ready attachment to, and ready removable detachment from, a hand or power sander.

10 Claims, 2 Drawing Sheets

CONFORMABLE SANDING ASSEMBLY

CROSS REFERENCE TO RELATED PATENT APPLICATION

This is a Continuation-in-Part of our co-pending U.S. patent application Ser. No. 733,340, filed on Jul. 22, 1991 and now U.S. Pat. No. 5,220,752.

BACKGROUND OF THE PRESENT INVENTION

The present invention relates to sanding devices.

The present invention further relates to sanding devices incorporating attachment means.

The present invention also relates to conformable sanding devices, incorporating flexible attachment means, designed for ready attachment to, and ready removable detachment from, a hand or power sanding means.

It has been a long standing problem in the field of hand sanding means to create devices which possess appropriate stiffness values, enabling operators to apply even pressure and achieve evenly sanded finishes.

The present invention combines solutions to these problems by enhancing stiffness while simultaneously providing a unique flexible attachment means. However, a sanding device must also be sufficiently elastic, resilient and, in particular, conformable if all manner of surfaces, non-planar as well as planar, are to be sanded. It is necessary to provide a sanding device capable of withstanding forces and pressures applied to them, by their operators, without compromising the nature of the sanded finish achieved. To achieve these goals, the present invention employs a compressible medium and incorporates a unique attachment means, for attaching a compressible sanding block to an orbital sanding machine.

When employing a sanding device, unevenly applied pressure produces an uneven finish. Attempts have been made to enhance the stiffness of sanding devices, often at the expense of conformability. The present invention addresses this two-fold problem by adding an incorporated flexible attachment means. Additionally, previous disclosures fail to provide a means for one-hundred (100) percent coverage of all types of surfaces which require sanding, i.e., surfaces having curved, or non-planar contours.

The sanding assembly of the present invention has a conformability to rigidity ratio enabling the operator to sand all types of contours, curves, rounds, moldings, and other non-planar surfaces. Basically, the requisite stiffness is achieved by the rigidity supplied by the unique flexible attachment means. This component of the present invention allows the operator to apply pressure to the compressible sanding block without attendant deformation. However, the unique flexible attachment means does not detract from the elasticity inherent in the compressible core of the sanding block. This allows the operator to push the sanding block into a plurality of different angular applications, while maintaining the proper sanding angle. The incorporated flexible attachment means provides for this by enhancing the stiffness, yet allowing for adequate flexion. Therefore, with the present invention, simultaneous sanding of intersecting planar surfaces is possible, above and beyond all prior disclosures. A search of related art makes it apparent that these features have never before been combined as they are in the present invention.

Early disclosures divulge attempts such as a flexible sanding pad, only for manual use, providing nothing to enhance the rigidity or allow for ready attachment and detachment. Abrasive articles are known with means for attachment, but no account is taken of rigidity or flexibility. Other disclosures further divulge coated abrasive pads and pads of flexible foam, designed only to protect the tools edges during the use of the abrasive pads. Alternative disclosures include means of attaching a non-conformable sanding block to a power-driven tool by use of a magnetic mounting means. No combinations of previous disclosures contemplate the teachings of the present invention.

The present invention overcomes the prior art problems of inadequate rigidity, inadequate orbital action and lack of ready attachment and detachment, through incorporation of the unique flexible attachment means running through and extending outward from the sanding block. Nothing previously disclosed anticipates or contemplates these improvements.

SUMMARY OF THE INVENTION

It is an objective of the present invention to provide a conformable sanding assembly having a unique flexible attachment means incorporated within the compressible sanding block, for ready attachment to, and ready removable detachment from, a hand or power means for sanding.

Another objective is to provide a sanding device capable of sanding all manner and angle of contoured non-planar surfaces with enhanced rigidity and efficiency.

Still another objective is to provide a sanding device capable of quick detachment from the sanding means, and reversal of the sanding block, with subsequent reattachment and ease of handling, resulting from the incorporated flexible attachment means.

The above and other objectives will become apparent in the description of the preferred embodiments.

A conformable sanding device for hand use or attachment to a power means for sanding, particularly useful for sanding contoured, non-planar surfaces and angles is described. The sanding device comprises a compressible sanding block coated on the major upper and lower peripheral surfaces with abrasive substance, and further comprises a unique flexible attachment means incorporated within the sanding block. The incorporated flexible attachment means is designed for ready attachment to, and ready removable detachment from, hand or power sander means.

In summary, and in accordance with the above discussion, the foregoing objectives are achieved in the following embodiments.

1. A conformable sanding assembly, comprising:

a block formed of a foamed elastomeric material;

said block having a predetermined shape, and being flexible and deformable, in response to the application of localized pressures thereon, but being elastically returnable to its predetermined shape, when such localized pressures are withdrawn;

said block having two parallel flat major faces, and four connecting side edges, extending between said flat faces;

said block having a thickness dimension normal to its flat major faces;

a sheet of abrasive material secured to one of the major faces of said block;

said abrasive sheet being coextensive with said one major face;

a stiff panel secured to the other major face of said block;

said stiff panel being coextensive with said other major face;

a first sheet of hook and loop attachment material bonded to said stiff panel;

a second mating sheet of hook and loop attachment material having a front fibrous surface adapted to detachably mate with said first sheet of hook and loop attachment material; and said second mating sheet of hook and loop attachment material having a back surface, and a film of pressure-sensitive adhesive thereon, whereby said second sheet of hook and loop material can be adhesively attached to a flat movable work surface of an orbital sanding machine.

2. The sanding assembly, as described in paragraph 1, wherein the thickness dimension of said block is at least three-fourths (¾) of an inch.

3. The sanding assembly, as described in paragraph 1, wherein:

the orbital sanding machine has a vibratable plate that forms the movable work surface;

said plate having a front end and a rear end, spaced apart to collectively define the length dimension of said plate;

a clamp means at each end of said plate; and said second sheet of hook and loop material having a length dimension that is greater than the length dimension of the plate so that end portions of said second sheet are extendable around the plate ends for fastening by said clamp means.

4. The sanding assembly, as described in paragraph 1, wherein said sheet of abrasive material is bent at the limits of said one major face, so as to extend along the side edges of the block.

5. A conformable sanding assembly comprising:

a block, formed of a foamed elastomeric material;

said block having a predetermined shape, and being flexible and deformable in response to the application of localized pressures thereon, but being elastically returnable to its predetermined shape when such localized pressures are withdrawn;

said block having two parallel flat major faces and four connecting side edges extending between said flat faces;

said block having a thickness dimension normal to its flat major faces;

a sheet of abrasive material secured to one of the major faces of said block;

said abrasive sheet being coextensive with said one major face;

a first sheet of hook and loop attachment material bonded to the other major face of said block;

a second mating sheet of hook and loop attachment material having a front fibrous surface, adapted to detachably mate with said first sheet of attachment material;

said second mating sheet of hook and loop attachment material having a back surface, and a film of pressure sensitive adhesive thereon;

said sanding assembly being adapted for mounting on an orbital sanding machine that includes a vibratable plate having a front end and a rear end, spaced apart to collectively define the length dimension of the plate, and a clamp means at each end of said plate;

said first sheet of hook and loop material having a length dimension that is greater than the length dimension of the plate; and whereby said second sheet of hook and loop material can be secured to the plate by pressing the adhesive film against the plate, while the end portions of said first sheet of hook and loop material are extended around the plate ends for fastening by said clamp means.

6. The sanding assembly, as described in paragraph 5, wherein the thickness dimension of said block is at least three-fourths (¾) of an inch.

7. The sanding assembly, as described in paragraph 5, wherein said sheet abrasive material is bent at the limits of said one major face, so as to extend along the side edges of the block.

8. A conformable sanding assembly comprising:

a block formed of a foamed elastomeric material;

said block having a predetermined shape, and being flexible and deformable in response to the application of localized pressures thereon, but being elastically returnable to its predetermined shape, when such localized pressures are withdrawn;

said block having two parallel flat major faces and four connecting side edges extending between said flat faces;

said block having a thickness dimension normal to its flat major faces;

a sheet of abrasive material secured to one of the major faces of said block;

said abrasive sheet being coextensive with said one major face;

a first sheet of hook and loop attachment material;

means permanently attaching said first sheet of hook and loop material to the other major face of said block;

a second mating sheet of hook and loop attachment material having a front fibrous surface adapted to detachably mate with said first sheet of hook and loop material;

said second mating sheet of hook and loop material having a back surface, and a film of pressure-sensitive adhesive thereon; and whereby said second sheet of hook and loop material can be adhesively attached to a flat movable work surface of an orbital sanding machine.

9. The sanding assembly, as described in paragraph 8, wherein the thickness dimension of said block is at least three quarters (¾) of an inch.

10. The sanding assembly, as described in paragraph 8, wherein:

the orbital sanding machine has a vibratable plate that forms the movable work surface;

said plate having a front end and a rear end, spaced apart to collectively define the length dimension of the plate;

a clamp means at each end of said plate; and one of said sheets of hook and loop material having a length dimension that is greater than the length dimension of the plate, so that end portions of said one sheet are extendable around the plate ends for fastening by said clamp means.

BRIEF DESCRIPTION OF THE DRAWINGS

In order that the present invention may be more fully and readily understood, and, further, that all features thereof may be better appreciated, the present invention will now be described by way of preferred examples, with reference to the accompanying drawings.

DESCRIPTION OF THE PREFERRED EMBODIMENTS OF THE PRESENT INVENTION

Figure 1:
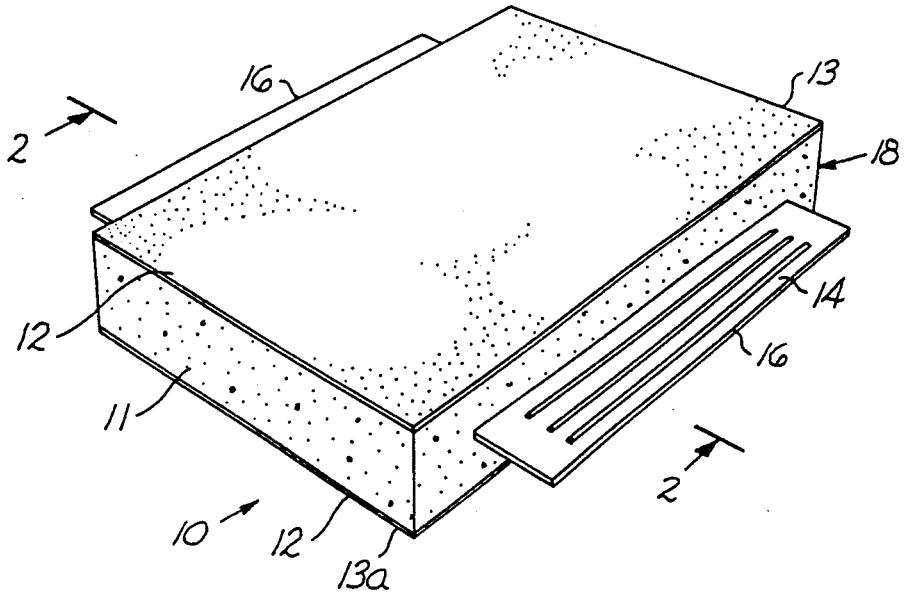
FIG. 1, is a perspective view, of the conformable sanding assembly, according to the present invention.

FIG. 1, is a perspective view of a conformable sanding device 10, embodying features of the present invention. The sanding block 18, here depicted as rectangular, comprises a compressible core 11, which is coated with a textured abrasive substance 12, on both major upper and lower flat faces 13 and 13A, respectively. The flexible attachment strap means 14, extends outward from and overhangs both the proximate and distal side edges of the sanding block 18. Enhanced orbital action is achieved by gripping the overhanging edges 16, of the flexible attachment means 14, which also enhance the rigidity of the sanding block 18. Compressibility of the block's core material 11, provides for sanding of non-planar surfaces with a plurality of angular, concave, or convex, contours and edges. The potential dual nature of the textured abrasive coating 12, allows the operator to turn the conformable sanding device easily, and use both faces 13 and 13A. This is done by simply turning the conformable sanding device, when one side is spent, or employing different types of abrasive on the major upper and lower faces, which are both readily accessible.

Figure 2:
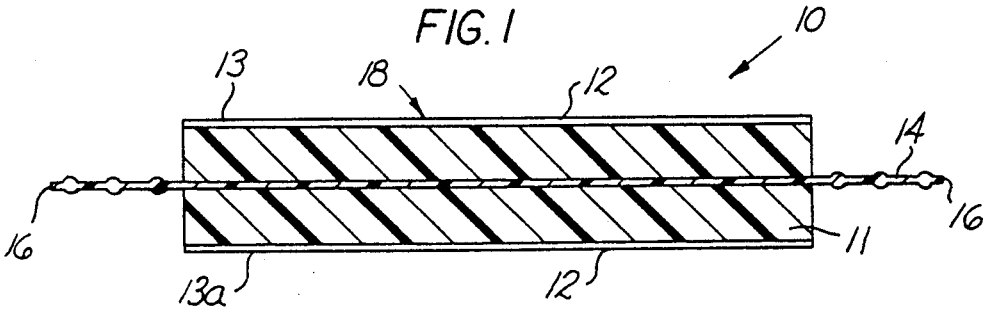
FIG. 2, is a cross-sectional view, of the conformable sanding assembly, taken along line 2—2, as seen in FIG. 1, illustrating the flexible attachment means which is incorporated within a compressible sanding block.

The embodiment of the present invention, as herein illustrated in FIG. 1, comprises a flexible strap attachment means 14, being disposed approximately equidistant between the major upper and lower flat faces 13 and 13A, of the sanding block 18. The major upper and lower faces, 13 and 13A, are coated with a textured abrasive substance 12, along the entire surface areas. The flexible strap attachment means 14, of the preferred embodiment, is from about 1/32 to about 1/16 of an inch thick. The flexible strap attachment means 14, extends outward from, and overhangs opposite side edges of the sanding block 18, by about 13/16 of an inch out of each of the ends of the sanding block 18, as depicted in the illustration of said embodiment in FIG. 1. As seen in FIG. 2, the thickness dimension of block 18, is approximately the same as the projection distance of strap 14, i.e., about 13/16 of an inch. The block 18, thickness dimension is thus several times the thickness dimension of strap 14. The configuration and other dimensions of the sanding device may vary to suit the application, and sanding machine 20, to which the device may be attached by strap means 14.

FIG. 2, is a cross-sectional view of the conformable sanding device 10, taken along line 2—2, as seen in FIG. 1, illustrating the flexible strap attachment means 14, incorporated within said sanding block 18.

The sanding block 18, comprises a core of compressible elastic material 11, covered with a coating of abrasive substance 12, on both major faces 13 and 13A. Orbital action is enhanced by use of the overhanging edges 16, of the flexible strap attachment means 14, allowing the operator to grip said device and to turn it over to use both major upper and lower faces 13 and 13A, coated with a textured abrasive substance 12. The conformability of said sanding device 10, is further enhanced by a linear rectangular slot (not numbered), cut through the sanding block 18, which incorporates the flexible attachment means 14. This rectangular slot in the compressible core material 11, of the sanding block 18, allows the operator to apply pressure to either of the major upper and lower faces 13 and 13A, without sacrificing the angle formed between the surface being sanded and the major upper and lower faces 13 and 13A, making contact therewith. This feature also enables the operator to apply downward pressure while gripping the overhanging edges 16, of the flexible tongue-like attachment means 14, to force the flattened bottom surface 13, to conform to any number of angles, contours, or irregularly shaped non-planar surfaces. The flexible attachment means 14, therefore, serves these dual purposes for the present invention.

Figure 3:
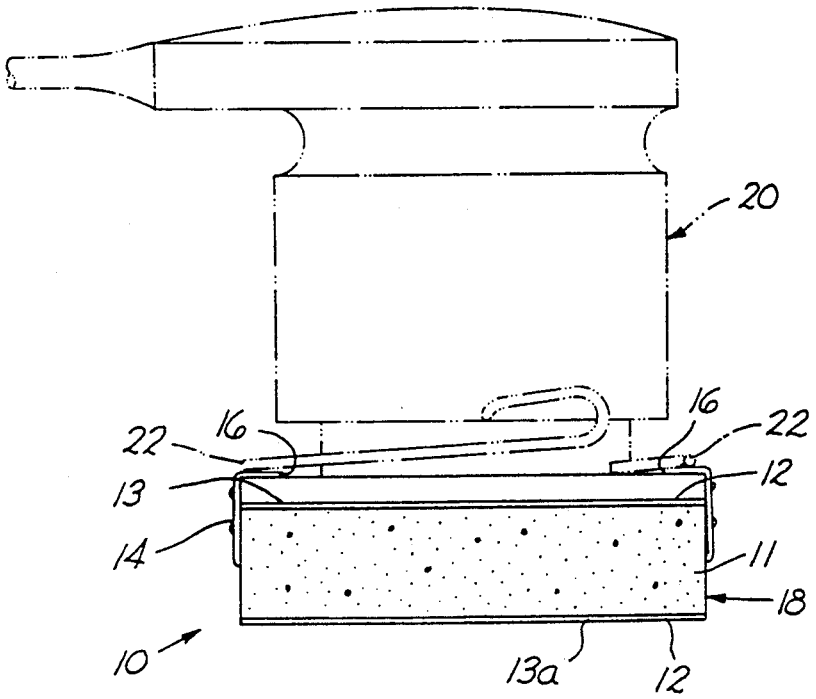
FIG. 3, shows the conformable sanding assembly of the present invention attached to a schematized power or hand means for sanding, illustrating the flexible attachment means and its connection to the power or hand means for sanding.

FIG. 3, shows the conformable sanding assembly 10, attached to a schematized power or hand sanding machine 20, illustrating the flexible strap attachment means 14, and its connection to the power or hand sanding machine 20.

The conformable sanding device 10, is coupled with said power sanding machine 20, by means of the overhanging edges 16, of the flexible attachment means 14. The overhanging edges 16, of the flexible strap attachment means 14, allow the power sanding means 20, to apply the necessary orbital or rotational force to the compressible sanding block 18. This feature provides substantial improvement over any disclosures heretofore available.

Having the compressible sanding block 18, attached to the power sanding machine 20, allows for the application of an appropriate degree of downward pressure to achieve a better sanding finish. This feature applies also to any hand uses of the conformable sanding device 10, as it permits the operator of the device to apply the requisite amount and degree of pressure with no danger of slippage or of creating an unevenly sanded finish through the application of uneven pressure. The overhanging edges 16, of the flexible attachment means 14, thus overcome yet another common problem in the sanding means field.

Additionally, said unique flexible attachment means 14, and overhanging edges 16, are designed for ready attachment and detachment of the conformable sanding assembly 10. This aspect of the current invention further provides for turning said sanding device as discussed above, when employed in conjunction with the power sanding machine 20.

Figure 4:
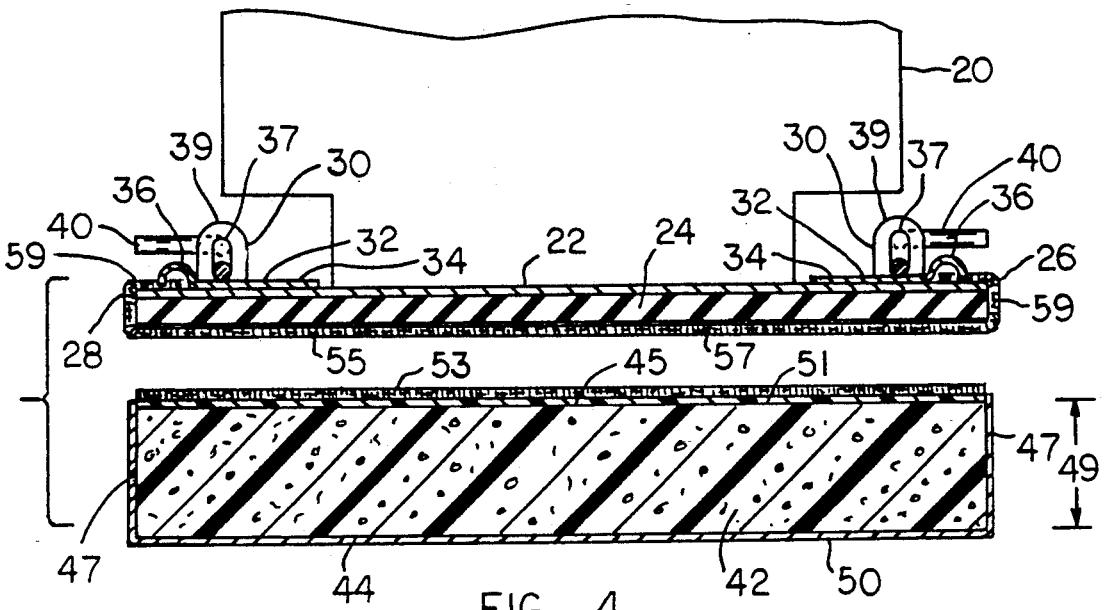
FIG. 4, is a sectional view, taken through another sanding assembly embodying the present invention, and showing the assembly in a detached position, relative to a conventional sanding machine.

FIG. 4, illustrates another form of the present invention, used in conjunction with a conventional hand-guided orbital sanding machine 20. The sanding machine 20, includes a vibratable steel plate 22, having a relatively hard rubber pad 24, affixed to its flat lower face. The plate 22, and rubber pad 24, have a rectangular plan configuration.

Plate 22, has a front end 26, and a rear end 28, spaced apart to define the length dimension of the plate 22. A sheet clamp means 30, is mounted on the upper surface of plate 22, at its front and rear ends, 26 and 28, respectively. Each clamp means 30, comprises a resilient steel spring arm 32, riveted, or otherwise affixed, at 34, to plate 22, and a curved clamp jaw 36, adapted to clamp a sheet of material, against the upper surface of plate 22.

Figure 5:
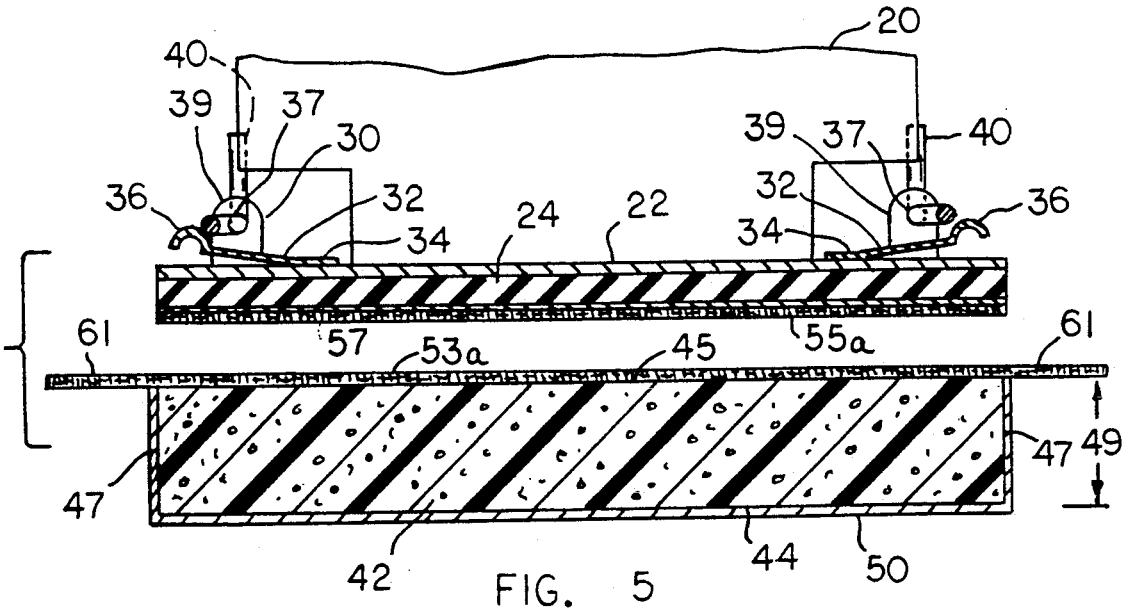
FIG. 5, is a sectional view, taken in the same direction as FIG. 4, but illustrating a further embodiment of the present invention.

A crank member 37, is supported in spaced bearings 39, such that an offset central portion of the crank member 37, presses against the surface of the spring arm 32. A handle 40, extends right-angularly from one end of the crank member 37, whereby the crank member 37, can be rotated around its rotational axis, for raising or lowering its offset central portion. FIG. 4, shows each crank member 37, in its lowered position, whereby its offset central portion is pressing spring arm 32, downwardly, to its clamping position. FIG. 5, shows each crank member 37, in its raised position, wherein the offset portion of the crank arm 37, is lifted away from plate 22. The resilience of each spring arm 32, causes the spring arm 32, to be lifted to a point where its curved jaw 36, is spaced away from plate 22. Handle 40, is turned one-quarter turn, to move the spring arm 32, between its raised and lowered positions.

The orbital sanding machine 20, depicted in FIGS. 4 and 5, is a conventional machine. The present invention, as shown in FIG. 4, concerns a conformable sanding assembly, usable with the conventional sanding machine. The sanding assembly, comprises a rectangular block 42, formed of a foamed elastomeric material, e.g., foamed plastic or foamed rubber. The block 42, has a flat lower face 44, and a flat major upper face 45. The major faces have four connecting side edges 47, whereby, the block 42, has a rectangular plan configuration, that is substantially the same as that of steel plate 22. Typically, block 42, will have a length of about five (5) or six (6) inches, and a width of about four (4) or five (5) inches. The block 42, will have a thickness dimension 49, measuring at least three-quarters ($\frac{3}{4}$) of an inch.

A sheet of abrasive material 50, is adhesively secured to the lower face 44 of the foam block 42. Sheet 50, entirely covers block major face 44, as well as the four (4) side edges 47, of the block 42. Thus the sheet 50, is bent along straight lines at the block 42 corners, to conform to the block surfaces at 44 and 47. Sheet 50, can be a conventional sheet of sandpaper, or other suitable abrasive materials.

A relatively stiff panel 51, of plastic, or other non-flexible material, is bonded to the upper major face 45, of the foam block 42, to form a mounting surface for a sheet of fibrous hook and loop attachment material 53. Such fibrous sheet material is available under the tradename VELCRO. A second mating sheet of the fibrous hook and loop attachment material 55, is mounted on the lower face of rubber pad 24.

Hook and loop material sheet 55, has a back, or upper, surface that is coated with a film of pressure sensitive adhesive 57, whereby sheet 55 can be adhesively attached to the flat vibratable work surface of the orbital sanding machine 20. Sheet 55, has a length that is somewhat greater than the corresponding length of steel plate 22, and rubber pad 24, such that end portions 59, of sheet 55, can be extended around the ends of plate 22, and onto the plate 22 upper surface. Clamps 30, are actuable, to secure the ends of sheet 55 to the vibratable work member, i.e., plate 22 and rubber pad 24. The central areas of sheet 55, engaged with the lower face of rubber pad 24, is secured to the sanding machine work surface by means of the pressure sensitive adhesive film 57. The combination of clamps 30, and pressure sensitive adhesive film 57, ensures a non-slip, secure attachment of hook and loop sheet 55 to the vibratable work surface of the sanding machine 20.

Hook and loop material sheet 53, is permanently bonded to relatively stiff panel 51, by way of any suitable adhesive, so that panel 53, becomes a permanent part of the sanding block. FIG. 4, shows the sanding block detached from the orbital sanding machine. The sanding block can be attached to the machine by moving the machine downwardly so that the fibers in the hook and loop sheet 55, interlock with the fibers in hook and loop sheet 53. When the fibers are thus interlocked, the stiff panel 51, acts to prevent the sheets 53 and 55, from separating, i.e, panel 51, sufficiently rigidifies sheet 53, such that it is not possible to peel sheet 53 away from sheet 55, in stages. The hook and loop fibers in the two sheets, i.e, 53 and 55, are maintained in a common horizontal plane, such that all of the interlocked fibers act together to prevent the separation of sheet 53, from sheet 55. A very secure connection is thus provided between the sanding machine 20, and the sanding block 42.

Separation of the sanding block 42, from the sanding machine 20, requires that clamps 30, be unlocked, as shown in FIG. 5. With the clamps 30, unlocked, the end portions 59, of sheet 55, can be drawn away from steel plate 22, so as to permit the adhesive film 57, to be separated from the lower face of pad 24. After sheet 55, has been separated from pad 24, it can be peeled away from sheet 53, since sheet 55, then is in a flexible, non-rigid state.

During use of the machine for sanding purposes the foamed resilient block 42, can be deformed in response to the application of localized pressures thereon. The sanding apparatus can partially wrap around curved convex surfaces, or conform to concave surfaces. When the localized pressure is withdrawn, the foam block 42, returns to its predetermined configuration. The sanding assembly can thus be used to sand, or smooth, a variety of planar, and non-planar surfaces.

FIG. 5, illustrates a variant of the apparatus depicted in FIG. 4, wherein a flexible sheet of hook and loop material 53*a*, is bonded directly to the upper major face 45, of the foam block 42. The foam block 42, has no stiffener panel similar to panel 51 of FIG. 4. End portions 61, of sheet 53*a*, extends beyond the side edges of foam block 42, for extension around the ends of plate 22 and pad 24.

A second sheet of mating hook and loop material 55*a*, has a film of pressure sensitive material 57, on its back surface, whereby the sheet can be detachably secured to the face of rubber pad 24, as shown in FIG. 5.

FIG. 5, shows the sanding block 42, detached from the orbital sanding machine. The block 42, is attached to the machine by moving the machine downwardly, so that the fibers in the mating sheets of hook and loop material interlock. End portions 61, of sheet 53*a*, are wrapped around the ends of plate 22, and fastened to the plate by clamps 30. The sanding block is securely fastened to the machine by the interlocked fibers in sheets 53*a*, and 55*a*, and by the clamps 30.

Removal of the sanding block 42, from the machine 20, is accomplished by releasing clamps 30, so that end portions 61, of sheet 53*a*, can be unwrapped from the vibratable plate 22. Since the sanding block 42, does not have a stiffener panel, it is relatively flexible. The block 42, can be peeled away from sheet 53*a*, which remains on the machine 20. FIG. 5, shows the sanding block 42, in its detached condition.

The present invention is concerned with the construction of the sanding block 42, and a hook and loop sheet, 55 or 55*a*, whereby the flexible, deformable block can be securely attached to a conventional sanding machine. The sanding assembly can be used for sanding planar, or non-planar surfaces.

The previous detailed description of the preferred embodiments of the present invention is presented for purposes of clarity of understanding only, and no unnecessary limitations should be understood or implied therefrom, as all appropriate mechanical and functional equivalents to the above, which may be obvious to those skilled in the arts pertaining thereto, are considered to be encompassed within the claims of this invention.

What is claimed is:

1. A conformable sanding assembly, comprising:

a block formed of a foamed elastomeric material;

said block having a predetermined shape, and being flexible and deformable, in response to the application of localized pressures thereon, but being elastically returnable to its predetermined shape, when such localized pressures are withdrawn;

said block having two parallel flat major faces, and four connecting side edges, extending between said flat faces;

said block having a thickness dimension normal to its flat major faces;

a sheet of abrasive material secured to one of the major faces of said block;

said abrasive sheet being coextensive with said one major face;

a stiff panel secured to the other major face of said block;

said stiff panel being coextensive with said other major face;

a first sheet of hook and loop attachment material bonded to said stiff panel;

a second mating sheet of hook and loop attachment material having a front fibrous surface adapted to detachably mate with said first sheet of hook and loop attachment material; and said second mating sheet of hook and loop attachment material having a back surface, and a film of pressure-sensitive adhesive thereon, whereby said second sheet of hook and loop material can be adhesively attached to a flat movable work surface of an orbital sanding machine.

2. The sanding assembly, as described in claim 1, wherein the thickness dimension of said block is at least three-fourths ($\frac{3}{4}$) of an inch.

3. The sanding assembly, as described in claim 1, wherein:

the orbital sanding machine has a vibratable plate that forms the movable work surface;

said plate having a front end and a rear end, spaced apart to collectively define the length dimension of said plate;

a clamp means at each end of said plate; and said second sheet of hook and loop material having a length dimension that is greater than the length dimension of the plate so that end portions of said second sheet are extendable around the plate ends for fastening by said clamp means.

4. The sanding assembly, as described in claim 1, wherein said sheet of abrasive material is bent at the limits of said one major face, so as to extend along the side edges of the block.

5. A conformable sanding assembly comprising:

a block, formed of a foamed elastomeric material;

said block having a predetermined shape, and being flexible and deformable in response to the application of localized pressures thereon, but being elastically returnable to its predetermined shape when such localized pressures are withdrawn;

said block having two parallel flat major faces and four connecting side edges extending between said flat faces;

said block having a thickness dimension normal to its flat major faces;

a sheet of abrasive material secured to one of the major faces of said block;

said abrasive sheet being coextensive with said one major face;

a first sheet of hook and loop attachment material bonded to the other major face of said block;

a second mating sheet of hook and loop attachment material having a front fibrous surface, adapted to detachably mate with said first sheet of attachment material;

said second mating sheet of hook and loop attachment material having a back surface, and a film of pressure sensitive adhesive thereon;

said sanding assembly being adapted for mounting on an orbital sanding machine that includes a vibratable plate having a front end and a rear end, spaced apart to collectively define the length dimension of the plate, and a clamp means at each end of said plate;

said first sheet of hook and loop material having a length dimension that is greater than the length dimension of the plate; and whereby said second sheet of hook and loop material can be secured to the plate by pressing the adhesive film against the plate, while the end portions of said first sheet of hook and loop material are extended around the plate ends for fastening by said clamp means.

6. The sanding assembly, as described in claim 5, wherein the thickness dimension of said block is at least three-fourths ($\frac{3}{4}$) of an inch.

7. The sanding assembly, as described in claim 5, wherein said sheet abrasive material is bent at the limits of said one major face, so as to extend along the side edges of the block.

8. A conformable sanding assembly comprising:

a block formed of a foamed elastomeric material;

said block having a predetermined shape, and being flexible and deformable in response to the application of localized pressures thereon, but being elastically returnable to its predetermined shape, when such localized pressures are withdrawn;

said block having two parallel flat major faces and four connecting side edges extending between said flat faces;

said block having a thickness dimension normal to its flat major faces;

a sheet of abrasive material secured to one of the major faces of said block;

said abrasive sheet being coextensive with said one major face;

a first sheet of hook and loop attachment material;

means permanently attaching said first sheet of hook and loop material to the other major face of said block;

a second mating sheet of hook and loop attachment material having a front fibrous surface adapted to detachably mate with said first sheet of hook and loop material;

said second mating sheet of hook and loop material having a back surface, and a film of pressure-sensitive adhesive thereon; and whereby said second sheet of hook and loop material can be adhesively attached to a flat movable work surface of an orbital sanding machine.

9. The sanding assembly, as described in claim 8, wherein the thickness dimension of said block is at least three quarters ($\frac{3}{4}$) of an inch.

10. The sanding assembly, as described in claim 8, wherein:

the orbital sanding machine has a vibratable plate that forms the movable work surface;

said plate having a front end and a rear end, spaced apart to collectively define the length dimension of the plate;

a clamp means at each end of said plate; and one of said sheets of hook and loop material having a length dimension that is greater than the length dimension of the plate, so that end portions of said one sheet are extendable around the plate ends for fastening by said clamp means.

* * * * *